US011821595B2

(12) United States Patent
Wang et al.

(10) Patent No.: US 11,821,595 B2
(45) Date of Patent: Nov. 21, 2023

(54) LINEAR LAMP

(71) Applicants: OPPLE LIGHTING CO., LTD., Shanghai (CN); SUZHOU OPPLE LIGHTING CO., LTD., Suzhou (CN)

(72) Inventors: Wenzhuo Wang, Suzhou (CN); Jianmin Xie, Suzhou (CN)

(73) Assignees: Suzhou Opple Lighting Co., Ltd., Suzhou (CN); Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 17/565,299

(22) Filed: Dec. 29, 2021

(65) Prior Publication Data

US 2022/0120392 A1 Apr. 21, 2022

Related U.S. Application Data

(63) Continuation of application No. PCT/CN2020/117995, filed on Sep. 27, 2020.

(30) Foreign Application Priority Data

Sep. 27, 2019 (CN) ..... 201910926861.5
Sep. 27, 2019 (CN) ..... 201921640948.8

(51) Int. Cl.
*F21S 4/28* (2016.01)
*F21K 9/275* (2016.01)
(Continued)

(52) U.S. Cl.
CPC ..... *F21S 4/28* (2016.01); *F21K 9/275* (2016.08); *F21V 17/16* (2013.01); *F21V 23/06* (2013.01); *F21Y 2103/10* (2016.08)

(58) Field of Classification Search
CPC ..... F21Y 2103/10; F21V 23/06; F21V 17/16; F21K 9/275; F21S 4/28
See application file for complete search history.

(56) References Cited

U.S. PATENT DOCUMENTS

2010/0008090 A1* 1/2010 Li ..... F21V 23/06 362/249.02

FOREIGN PATENT DOCUMENTS

CN 101033835 A 9/2007
CN 107477529 A 12/2017
(Continued)

OTHER PUBLICATIONS

International Search Report of PCT Application No. PCT/CN2020/117995 dated Jan. 4, 2021 with English translation, (6p).

*Primary Examiner* — Anabel Ton
(74) *Attorney, Agent, or Firm* — Arch & Lake LLP

(57) ABSTRACT

The present disclosure discloses a linear lamp. The linear lamp includes housings and a splicing member, the number of the housings is at least two, the splicing member is mounted at an end of each of the housings, and the two adjacent splicing members are in snap-fit connection to splice the two adjacent housings together. The splicing member comprises a main body, a first side body, and a second side body, the first side body and the second side body are connected to two ends of the main body, the first side body comprises a first snap-fit part, the second side body comprises a second snap-fit part, and the first snap-fit part of one splicing member and the second snap-fit part of the splicing member adjacent to the one splicing member are in snap-fit connection.

20 Claims, 15 Drawing Sheets

(51) Int. Cl.

| | |
|---|---|
| ***F21V 17/16*** | (2006.01) |
| ***F21V 23/06*** | (2006.01) |
| *F21Y 103/10* | (2016.01) |

(56) References Cited

FOREIGN PATENT DOCUMENTS

| | | | |
|---|---|---|---|
| CN | 207065501 | U | 3/2018 |
| CN | 208967739 | U | 6/2019 |
| CN | 110566855 | A | 12/2019 |
| EP | 2295847 | A2 | 3/2011 |

* cited by examiner

LINEAR LAMP

CROSS-REFERENCE TO RELATED APPLICATIONS

This application is based upon and claims the priority of PCT patent application No. PCT/CN2020/117995 filed on Sep. 27, 2020 which claims priority to the Chinese patent application No. 201910926861.5 filed on Sep. 27, 2019, and the Chinese patent application No. 201921640948.8 filed on Sep. 27, 2019, the entire contents of which are hereby incorporated by reference herein for all purposes.

TECHNICAL FIELD

The present disclosure relates to the field of lighting technology, and in particular, to a linear lamp.

BACKGROUND

Long-distance linear lamps are needed in places such as shopping malls and office buildings. The long-distance linear lamps are generally formed by splicing a plurality of linear lights.

BACKGROUND

The present disclosure provides a linear lamp. The linear lamp may include housings and a splicing member, the number of the housings may be at least two, the splicing member may be mounted at an end of each of the housings, and the two adjacent splicing members may be in snap-fit connection to splice the two adjacent housings together.

It is to be understood that both the foregoing general description and the following detailed description are exemplary and explanatory only and are not restrictive of the present disclosure.

BRIEF DESCRIPTION OF THE DRAWINGS

The accompanying drawings described herein are provided for further understanding of the present disclosure, and constitute a portion of the present disclosure. The illustrative examples of the present disclosure and the descriptions thereof are intended to explain the present disclosure, rather than to constitute improper limitations on the present disclosure.

DETAILED DESCRIPTION

Figure 1:
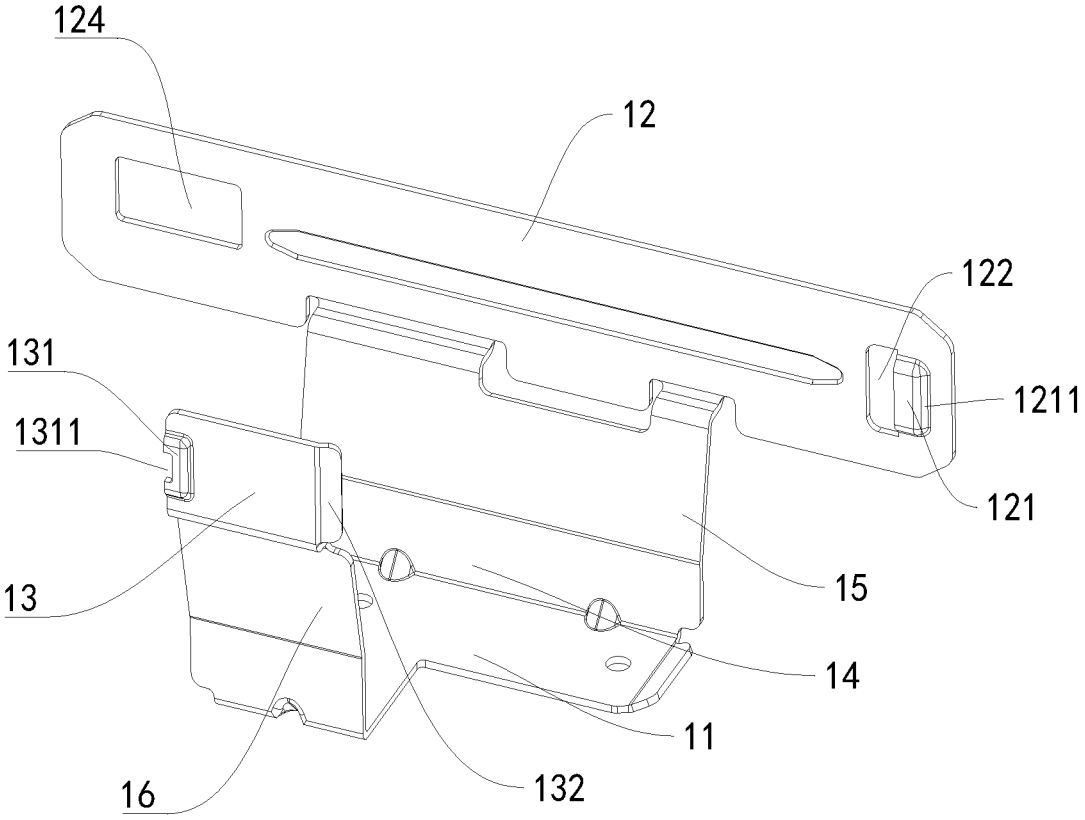
FIG. 1 is a perspective view of a splicing member according to an example of the present disclosure.

In order to make objects, technical solutions and advantages of the present disclosure apparent, the technical solutions of the example will be described in a clearly and fully understandable way in connection with the examples of the present disclosure and the drawings related to the examples of the present disclosure. The described examples are just a part but not all of the examples of the present disclosure. Based on the described examples herein, those skilled in the art can obtain other example(s), without any inventive work, which should be within the protection scope of the present disclosure.

Names and reference numerals in this disclosure may include:

Splicing member 10; Main body 11; First side body 12; First snap-fit part 121; Guide slope 1211; First snap-fit surface 1212; Through-hole 122; Avoiding space 124; Reinforcing rib 125; Second side body 13; Second snap-fit part 131; Groove 1311; Second snap-fit surface 1312; Second guide part 132; Accommodating space 14; First connection body 15; Second connection body 16; Housing 20; First mounting space 21; Strip-shaped rib 22; Slot 23; Bottom plate 24; Side plate 25; snap-fit strip 26; Transition module 29; Connector 30; Accommodating cavity 31; Side arm 32; Bottom arm 33; Hook 321; Slope 3211; Photoelectric module 40; snap-fit body 41; Lining plate 42; Opening 421; Light source plate 43; Light source 431; Electrical connection terminal 44; Female head 441; Male head 442; Conversion terminal 45; Power supply 46; Light distribution component 50; Movement gap 60; and End cover 70.

The linear light is formed by assembling a lamp shell, a photoelectric module disposed in the lamp shell, and a diffusion cover mounted at an open end of the lamp shell. When the linear lights are spliced, the adjacent lamp shells are spliced together, the adjacent photoelectric modules are spliced together, and the adjacent diffusion covers are spliced together. Sometimes, adjacent lamp shells are connected together by using a screw, and the splicing process is complicated.

Figure 3:
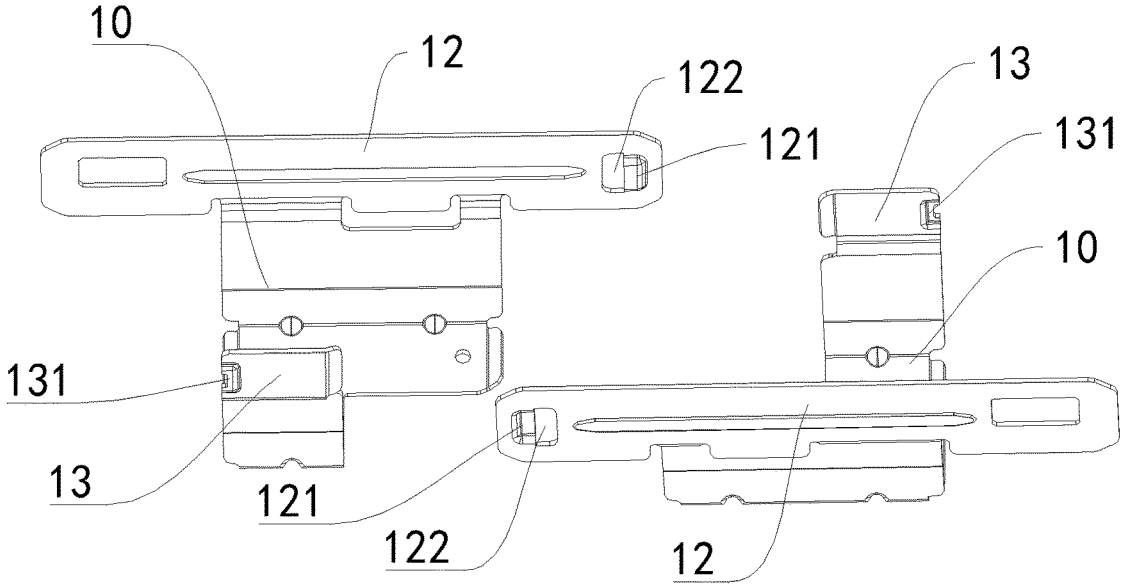
FIG. 3 is an exploded view of two splicing members according to an example of the present disclosure.
Figure 4:
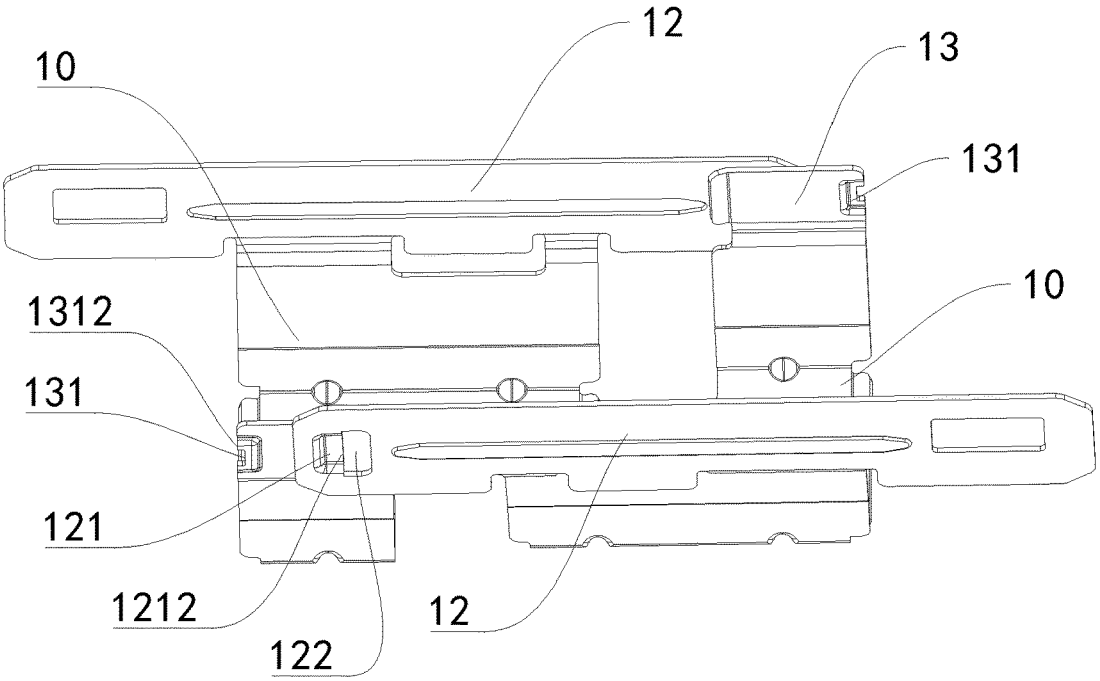
FIG. 4 is a diagram illustrating a splicing process of two splicing members according to an example of the present disclosure.

As shown in FIG. 3 and FIG. 4, the example discloses a linear lamp. The linear lamp includes a housing 20 and a splicing member 10, where the number of the housing 20 is at least two.

Each of the splicing member 10 includes a main body 11, a first side body 12, and a second side body 13, wherein the first side body 12 and the second side body 13 are connected to and distributed on two opposite sides of the main body 11 respectively. A first snap-fit part 121 is provided in the first side body 12. A second snap-fit part 131 is provided in the second side body 13. The splicing member 10 has specific elasticity. For example, the splicing member 10 may be a metal sheet. The main body 11, the first side body 12, and the second side body 13 may be integrally formed, or the main body 11, the first side body 12, and the second side body 13 may be welded and connected together.

The first snap-fit part 121 of the first splicing member 10 and the second snap-fit part 131 of the second splicing member 10 are in snap-fit connection. The second snap-fit part 131 of the first splicing member 10 and the first snap-fit part 121 of the second splicing member 10 are in snap-fit connection. That is, the first snap-fit part 121 of one splicing member 10 and the second snap-fit part 131 of the adjacent splicing member 10 are in snap-fit connection. Therefore, the adjacent splicing members 10 are spliced together. After the splicing member 10 is mounted at an end of the housing 20, the adjacent splicing members 10 are spliced together, so that the two adjacent housings 20 are spliced together.

In the example, the splicing member 10 is simple in structure and convenient to be spliced. The two splicing members 10 are opposite in placement direction and are connected to the adjacent housings 20 respectively, and then the two splicing members 10 are spliced, so that the two adjacent housings 20 can be rapidly spliced together. In the example, when the housings 20 are connected, the splicing members 10 with a same structure are used, so that design cost can be reduced.

Figure 7:
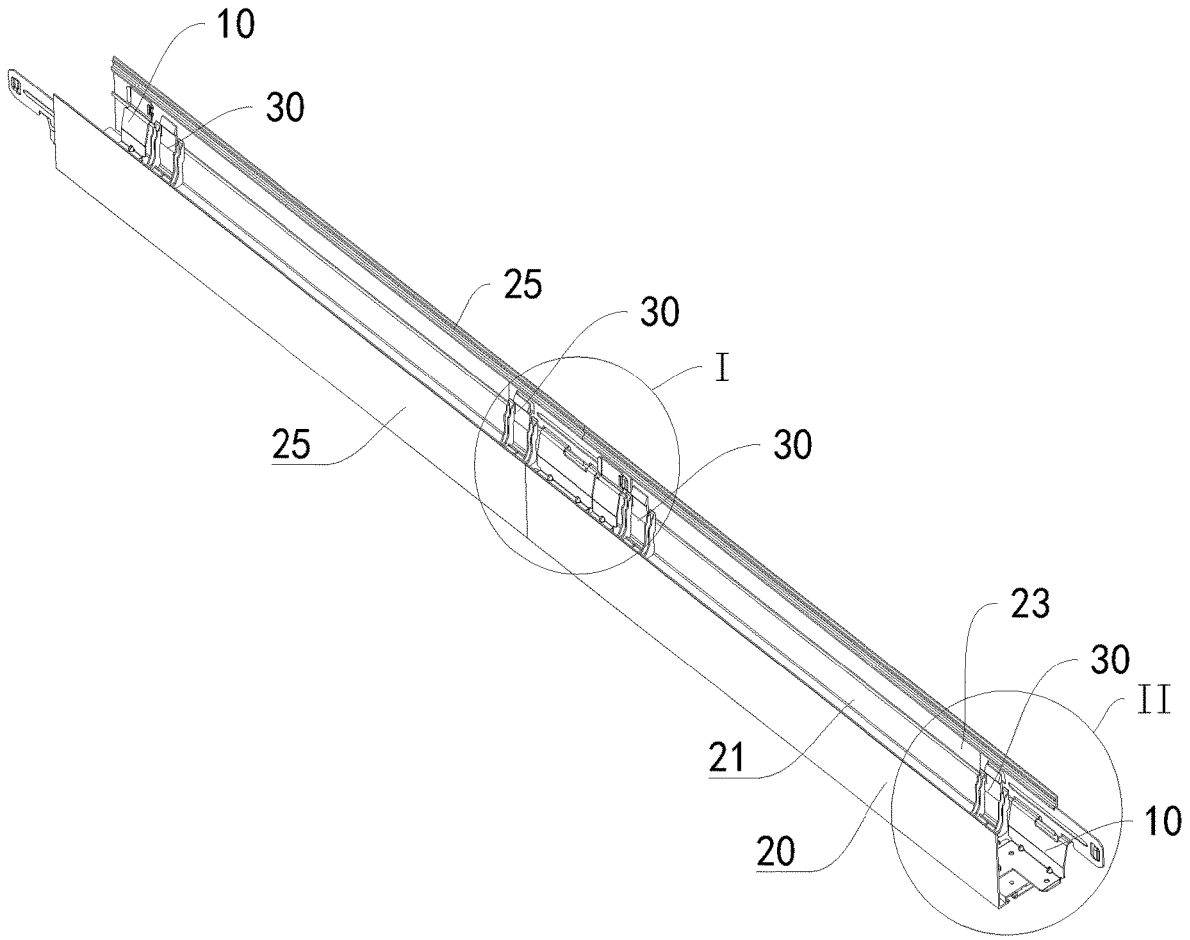
FIG. 7 is a diagram illustrating a positional relationship between a splicing member and a connector and a housing according to an example of the present disclosure.
Figure 10:
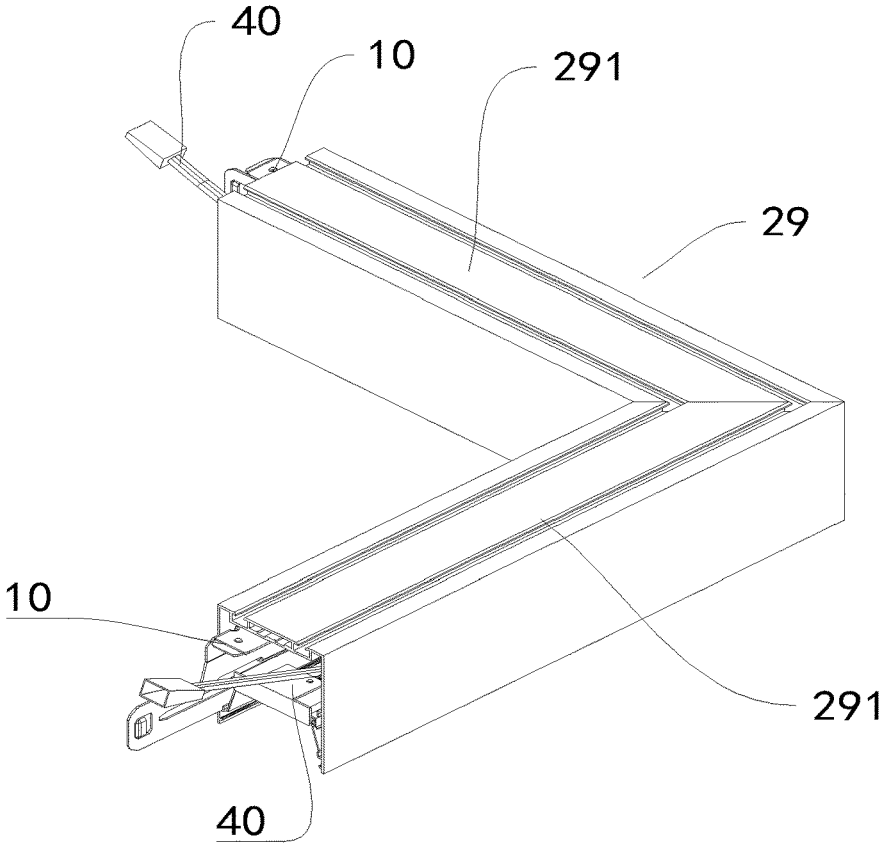
FIG. 10 is a schematic structural diagram of a first transition module according to an example of the present disclosure.
Figure 11:
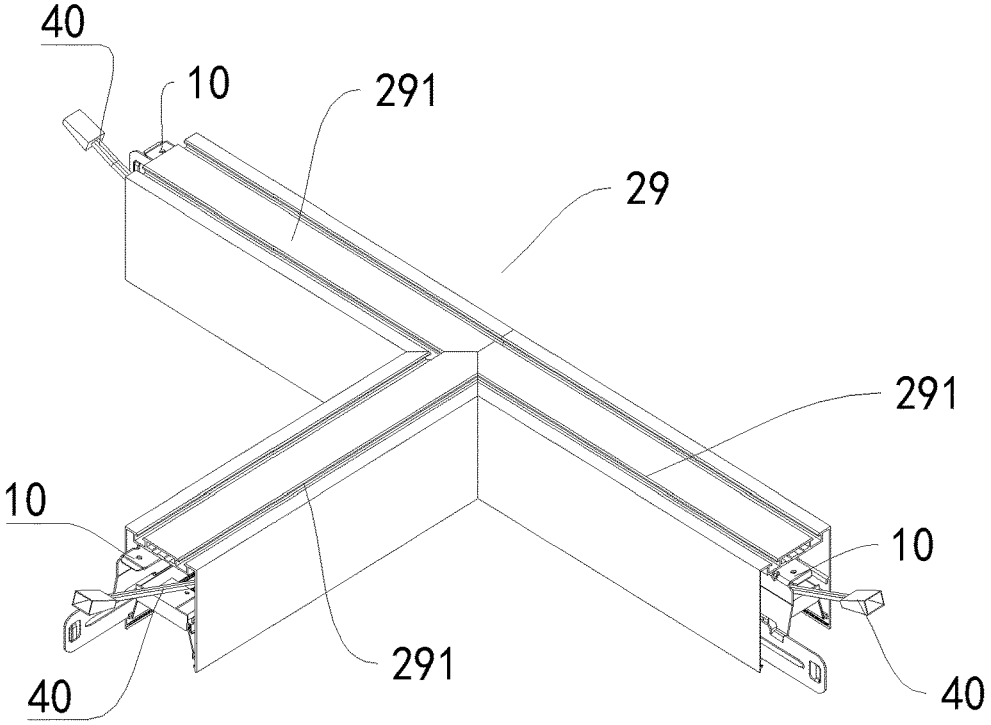
FIG. 11 is a schematic structural diagram of a second transition module according to an example of the present disclosure.
Figure 12:
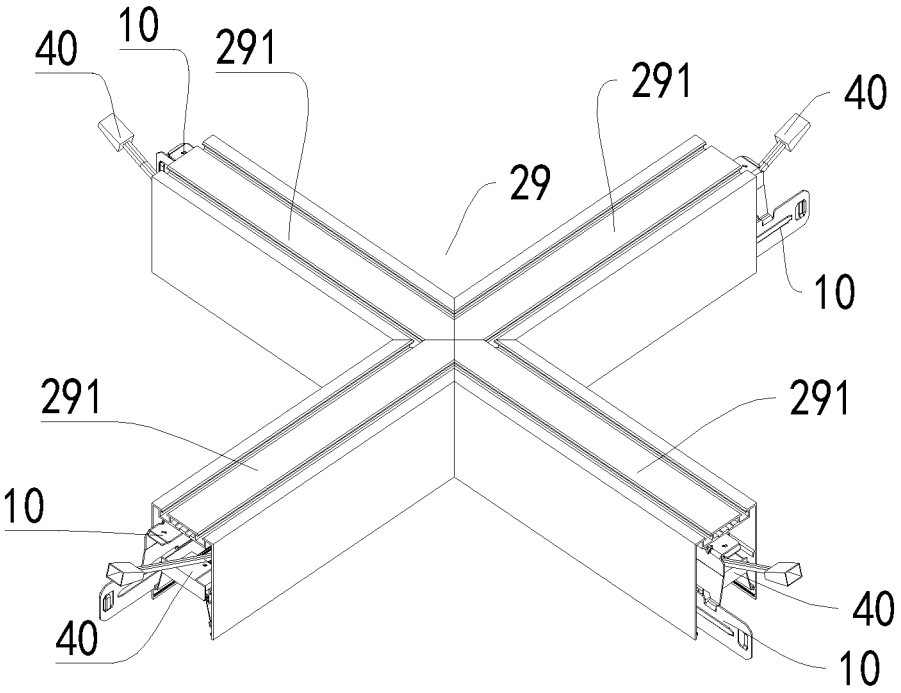
FIG. 12 is a schematic structural diagram of a third transition module according to an example of the present disclosure.
Figure 24:
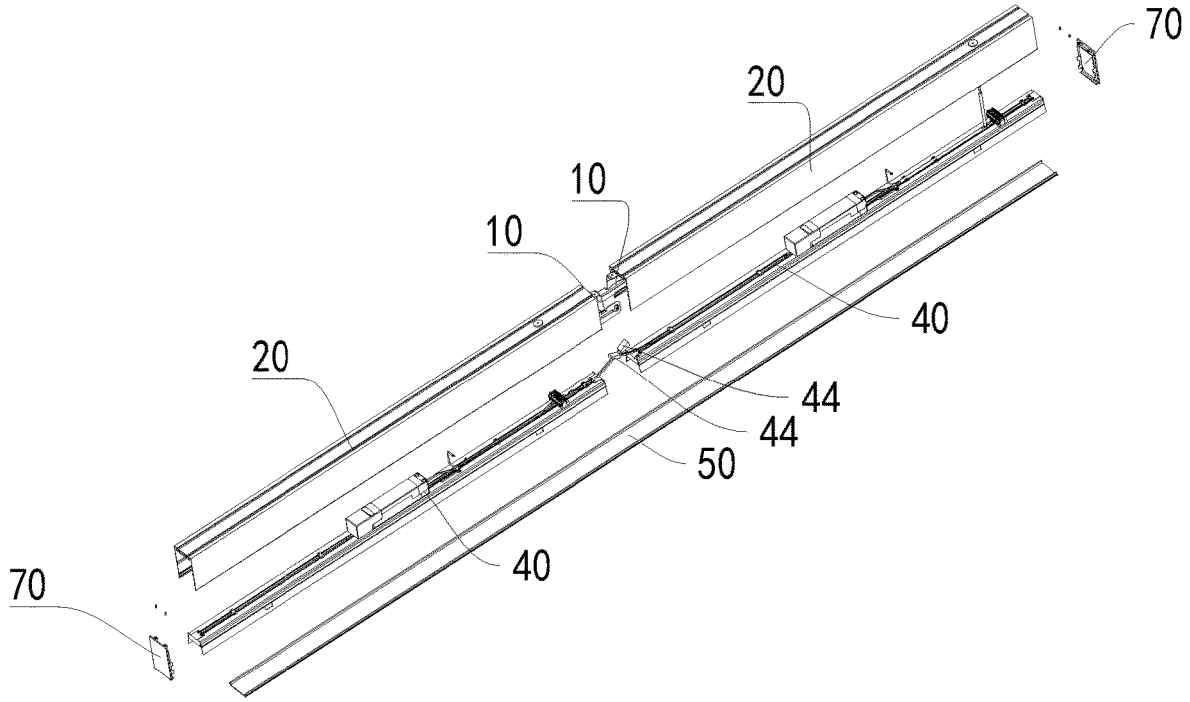
FIG. 24 is an exploded view of a linear lamp according to an example of the present disclosure.

As shown in FIG. 7, the splicing members 10 are mounted at two ends of each housing 20 respectively. As shown in FIG. 10 to FIG. 12, the housing 20 has two or more ends, and the splicing member 10 is mounted at each end. As shown in FIG. 24, an end cover 70 is provided on an outer end of the housing 20 located on a tail portion of the linear lamp, and the splicing member 10 is mounted at an inner end. The housings 20 with different structures and the housings 20 in different positions are provided with different numbers of splicing members 10, which can be arranged according to actual needs.

Figure 15:
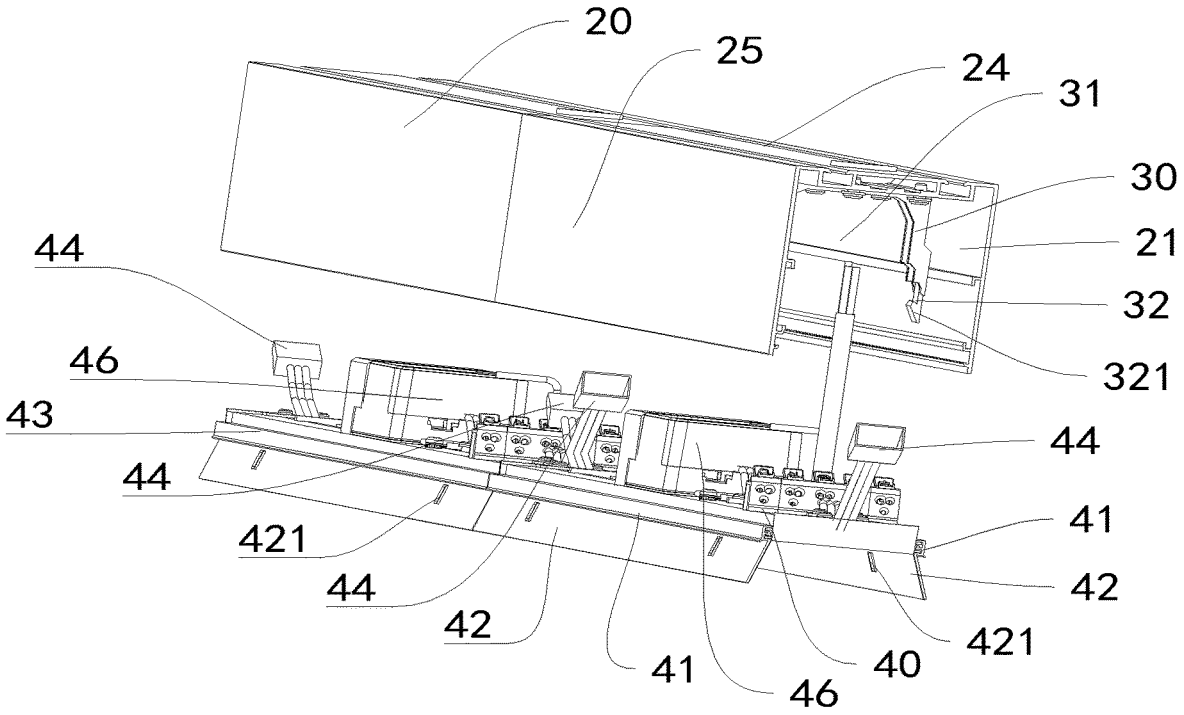
FIG. 15 is an exploded view of a photoelectric module and a housing according to an example of the present disclosure.

As shown in FIG. 15, the housing 20 includes a bottom plate 24 and two side plates 25, wherein the bottom plate 24 and the two side plates 25 are connected and enclose a first mounting space 21. After the two adjacent housings 20 are spliced together, facing end faces are attached together, and the splicing members 10 are entirely located in the first mounting space 21. In the example, due to the structure of the splicing members 10, the splicing members 10 can still be spliced together after being detached from the housing 20. Referring to FIG. 4 and FIG. 7, the first side body 12 of one splicing member 10 is limited in an outward direction by an inner side wall of one side plate 25 of the housing 20, and the first side body 12 of the adjacent splicing member 10 is limited in an outward direction by an inner side wall of the other side plate 25 of the housing 20. Because the splicing members 10 have specific elasticity, the second side body 13 is located on an inner side of the first side body 12 and can exert outward extrusion force on the first side body 12. The side plate 25 has the function that when the second side body 13 outward extrudes the first side body 12, the side plate 25 can prevent the first side body 12 from moving outward, so that the second side body 13 is closely attached to the first side body 12, and the first snap-fit part 121 and the second snap-fit part 131 can be more reliably in snap-fit connection.

In the example, the splicing members 10 have specific elasticity, so that the first snap-fit part 121 and the second snap-fit part 131 can more easily achieve snap-fit connection. In addition, the limiting effect of the side plate 25 prevents the first side body 12 from moving outward due to elasticity.

Figure 2:
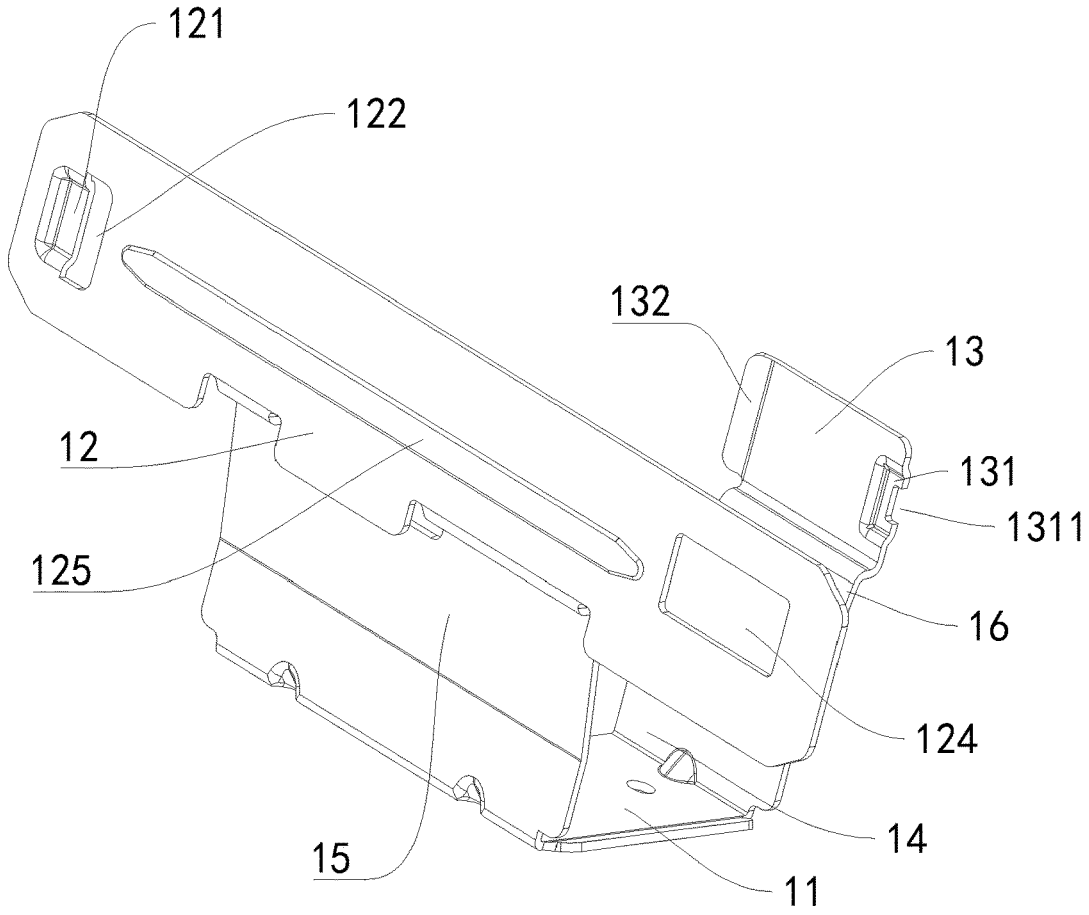
FIG. 2 is a perspective view of a splicing member according to an example of the present disclosure from another viewing angle.
Figure 9:
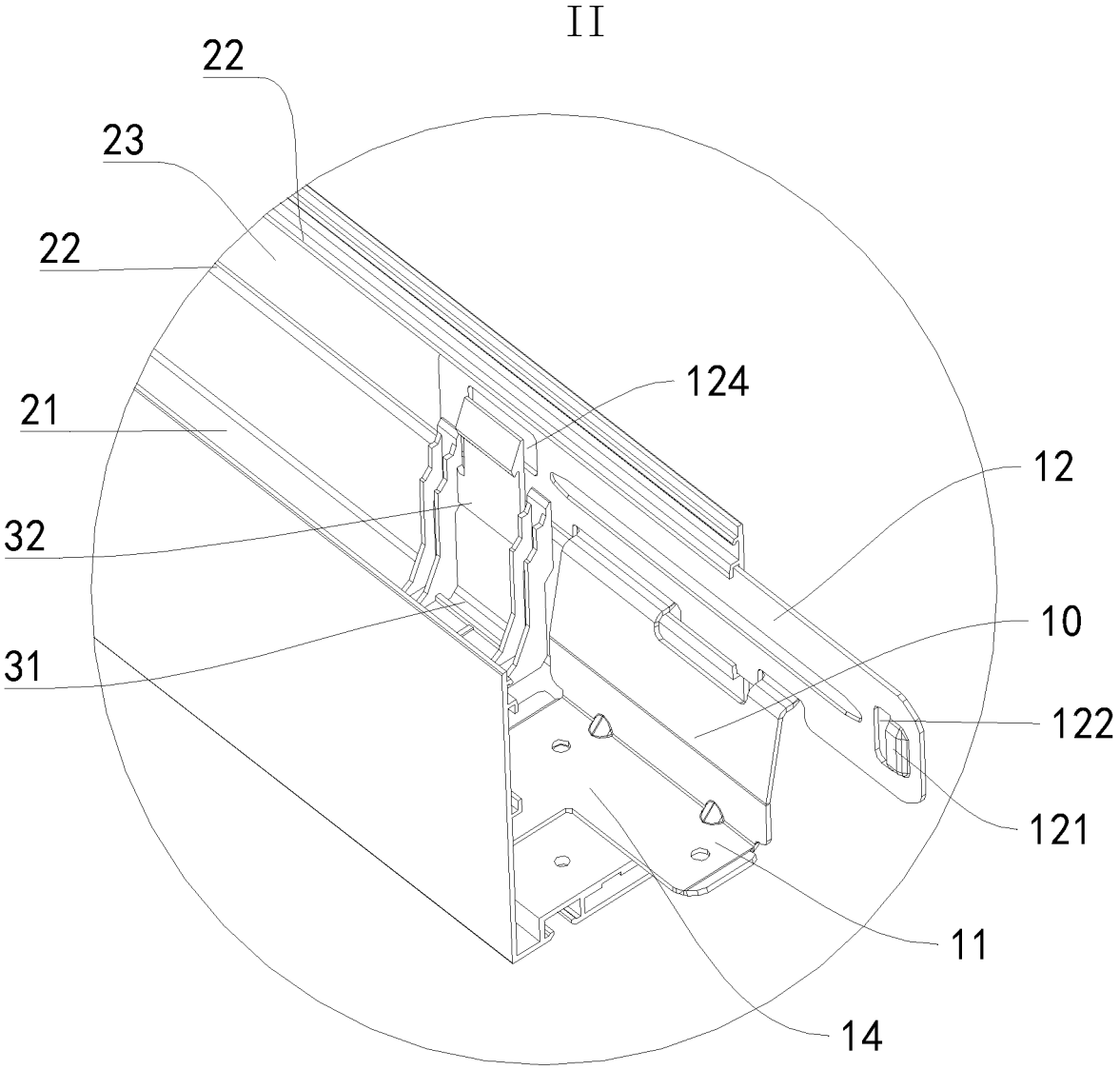
FIG. 9 is a partially enlarged view of a position II in FIG. 7.

As shown in FIG. 1 and FIG. 2, the first side body 12, the second side body 13, and the main body 11 enclose an accommodating space 14. As shown in FIG. 7 and FIG. 9, the splicing member 10 is inserted into the first mounting space 21, and the main body 11 is fixed to the bottom plate of the housing 20 by using a screw, so that the splicing member 10 is fixed in the housing 20, and the accommodating space 14 communicates with the first mounting space 21. The main body 11 is attached to the bottom plate 24 of the housing 20, and the first side body 12 and the second side body 13 are parallel to and closer to the two side plates 25 respectively, so that the splicing member 10 in the example not only can rapidly connect the two adjacent housings 20, but also has the advantages of being small in occupied space and capable of accommodating other parts, for example, the accommodating space 14 may accommodate the photoelectric module 40.

Figure 6:
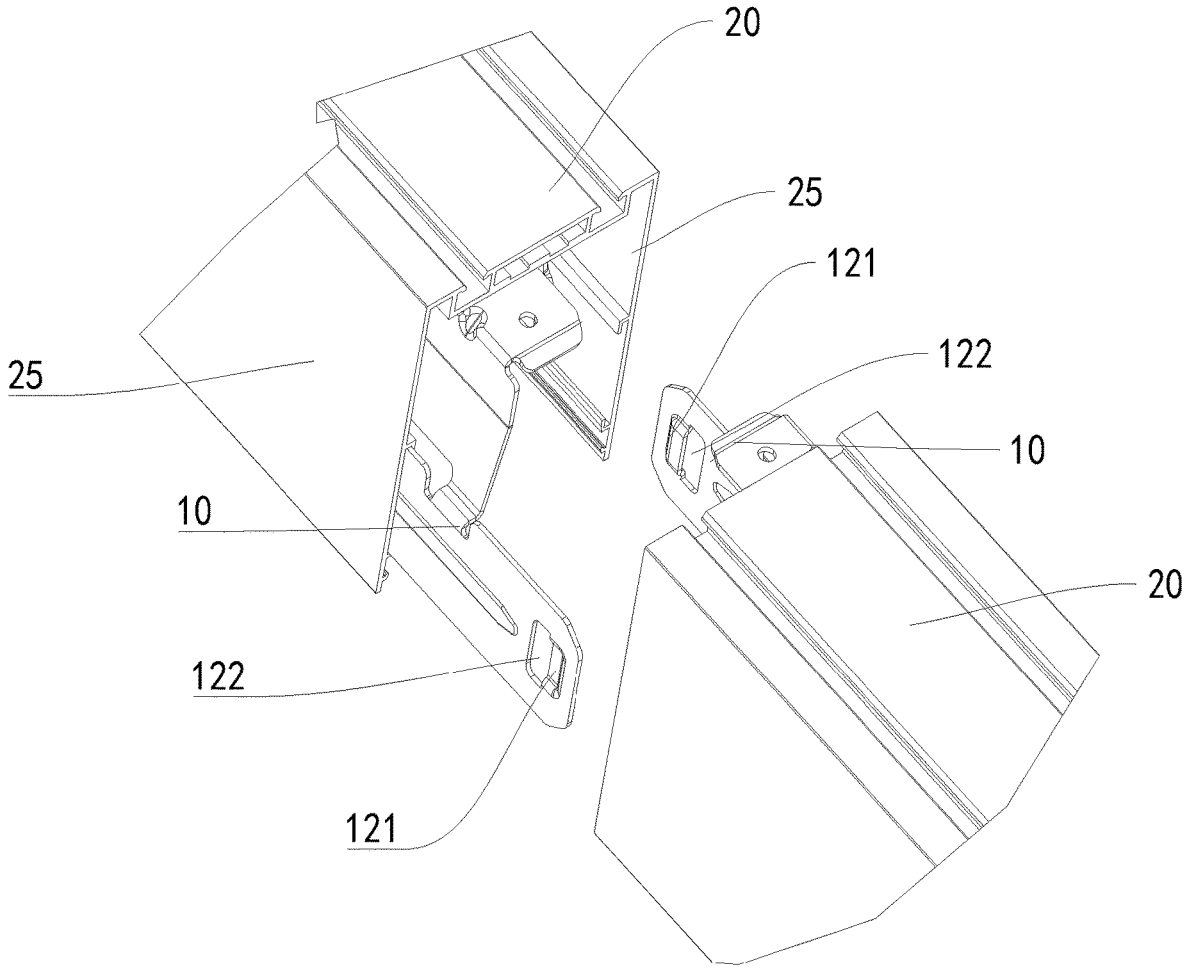
FIG. 6 is a partial view of a spliced position in FIG. 5.

As shown in FIG. 9, two strip-shaped ribs 22 spaced from each other are provided on the inner side wall of the side plate 25, the strip-shaped ribs 22 extend in a length direction of the housing 20, a slot 23 is formed between the two strip-shaped ribs 22, and a length direction of the slot 23 is consistent with the length direction of the housing 20. The splicing member 10 further includes a first connection body 15, one end of the first connection body 15 is connected to the main body 11, and the other end of the first connection body 15 is bent away from the second side body 13 toward the slot 23 and is connected to the first side body 12. The splicing member 10 further includes a second connection body 16, one end of the second connection body 16 is connected to the main body 11, and the other end of the second connection body 16 is bent away from the first side body 12 toward another slot 23 and is connected to the second side body 13. When the splicing member 10 is inserted into the first mounting space 21 from a port of the housing 20, in the presence of a bent part of the first connection body 15, the first side body 12 can be inserted into the slot 23. In the presence of a bent part of the second connection body 16, the second side body 13 can be closer to the slot 23, or the second side body 13 is also inserted into the slot 23. In this case, as shown in FIG. 6, the first side body 12 is limited in an outward direction by a slot bottom of the slot 23. The slot 23 can also limit the first side body 12 in an up and down direction and prevent the first side body 12 from dislocation, so that the first snap-fit part 121 and the second snap-fit part 131 are easily in snap-fit connection. The up and down direction herein is consistent with a width direction of the slot 23.

In the example, the first side body 12 and the second side body 13 of the linear lamp both extend in the length direction of the housing 20, the length of the first side body 12 is larger, and the second side body 13 may be disposed directly facing the middle of the first side body 12. As shown in FIG. 1, a left end of the first side body 12 and a right end of the second side body 13 are different-side ends, or a right end of the first side body 12 and a left end of the second side body 13 are different-side ends. The first snap-fit part 121 and the second snap-fit part 131 are distributed at the different-side ends of the first side body 12 and the second side body 13, so that the two splicing members 10 can have more overlapped parts when being spliced, and space can be saved.

A through-hole 122 is provided on the first side body 12, the first snap-fit part 121 is disposed adjacent to the through-hole 122, and an edge of the first snap-fit part 121 forms a side wall of the through-hole 122. The first snap-fit part 121 is formed by partially recessing the first side body 12 toward the second side body 13, which is beneficial to reduce the number of components and parts. The first snap-fit part 121 protrudes out of an inner side surface of the first side body 12. The inner side surface of the first side body 12 is a surface facing toward the second side body 13.

Figure 8:
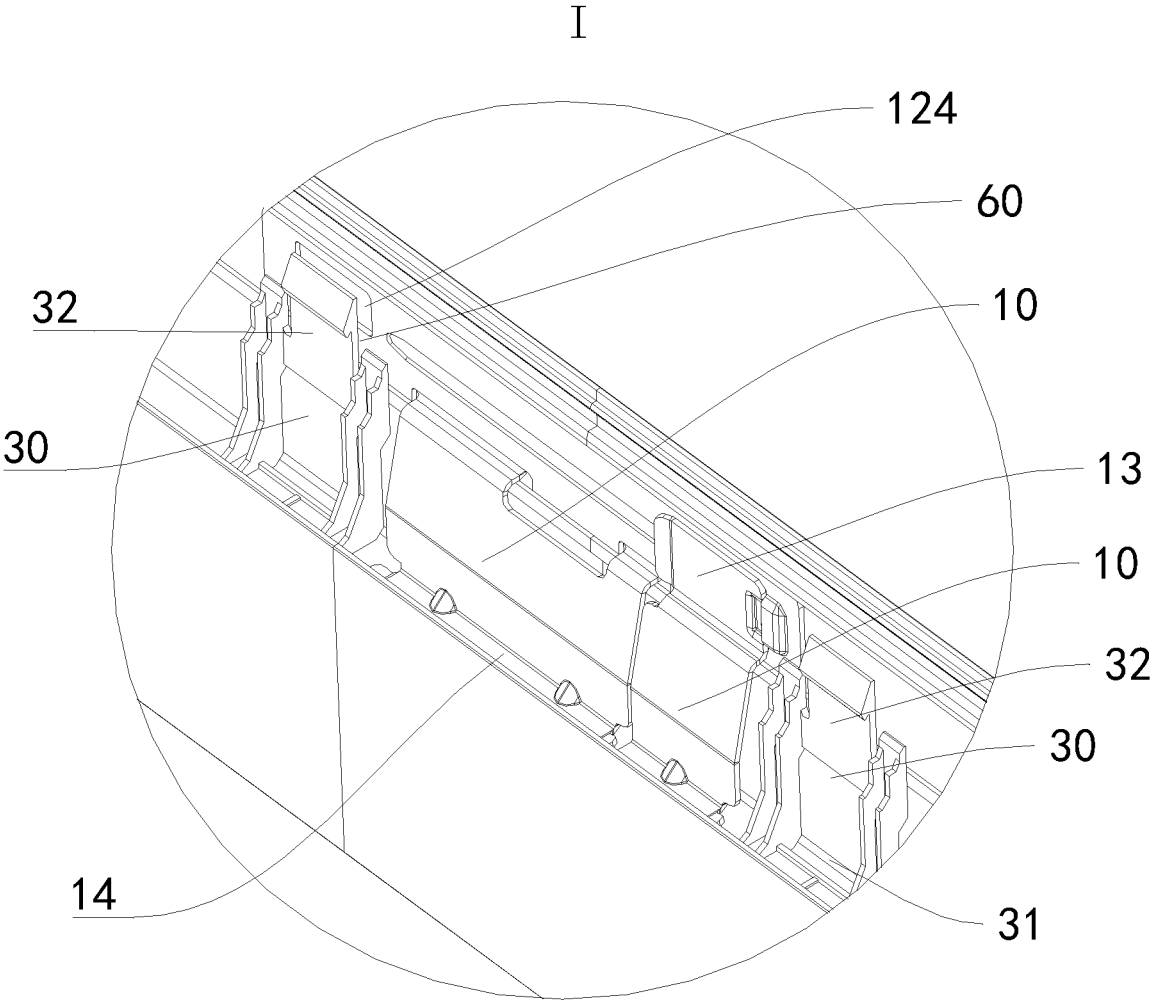
FIG. 8 is a partially enlarged view of a position I in FIG. 7.

As shown in FIG. 8, the through-hole 122 can accommodate a portion of the second snap-fit part 131, so that a contact area of the first snap-fit part 121 and the second snap-fit part 131 is relatively larger, which further improves reliability of the snap-fit connection of the first snap-fit part 121 and the second snap-fit part 131. A guide slope 1211 is provided on a surface of the first snap-fit part 121 facing toward the second side body 13, and the guide slope 1211 is used to improve splicing smoothness of the two splicing members 10.

The second snap-fit part 131 is formed by partially recessing the second side body 13 away from the first side body 12, which is beneficial to reduce the number of components and parts. The second snap-fit part 131 protrudes out of an outer side surface of the second side body 13. The outer side surface of the second side body 13 is a surface facing away from the first side body 12. The second snap-fit part 131 extends from an end face of the second side body 13 to the other end of the second side body 13, a groove 1311 is provided on the second snap-fit part 131, and the groove 1311 extends from an end face of the second side body 13 to the other end of the second side body 13. A second guide part 132 bent toward the first side body 12 is provided at the other end of the second side body 13, thereby improving splicing smoothness of the two splicing members 10.

As shown in FIG. 4, surfaces of the snap-fit connection of the first snap-fit part 121 and the second snap-fit part 131 are a first snap-fit surface 1212 and a second snap-fit surface 1312 respectively, and the first snap-fit surface 1212 and the second snap-fit surface 1312 face each other and are in snap-fit connection. In the presence of the groove 1311, during detachment, a tool is easily inserted into the groove 1311 and pries the first snap-fit part 121 and the second snap-fit part 131 so as to separate the first snap-fit part 121 and the second snap-fit part 131.

A protruding height of the second snap-fit part 131 is less than a depth of the through-hole 122, that is, the depth of the through-hole 122 is larger, so that the second snap-fit part 131 cannot extend out of an outer surface of the first side body 12, the first side body 12 is attached to the slot bottom of the slot 23, occupied space is saved, and it can be ensured that the slot bottom of the slot 23 can limit the first side body 12. The outer surface of the first side body 12 is a surface of the first side body 12 facing away from the second side body 13. The slot bottom of the slot 23 is a side wall of the housing 20 located in the slot 23.

Because the first side body 12 has specific elasticity and a larger length, and a reinforcing rib 125 is provided on the first side body 12 and are used to increase insertion reliability of the first side body 12 and the slot 23. The reinforcing rib 125 may extend in the length direction of the first side body 12.

Figure 5:
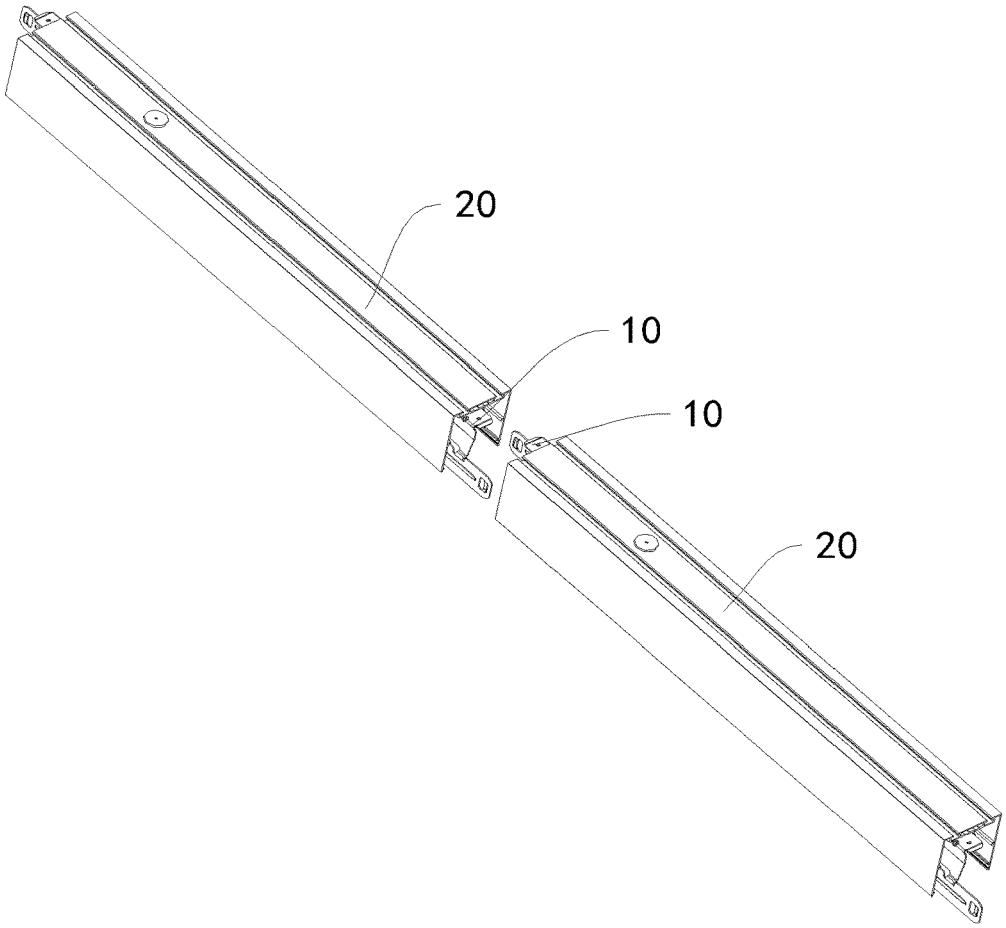
FIG. 5 is a diagram illustrating a splicing structure of adjacent housings according to an example of the present disclosure.

FIG. 5 and FIG. 6 show two straight-line shape housings 20. As shown in FIG. 10 to FIG. 12, the housing 20 includes a transition module 29, and the transition module 29 is used at a turn. The transition module 29 includes at least two extension parts 291, and the at least two extension parts 291 are perpendicular to each other.

As shown in FIG. 10, the number of the extension parts 291 is two, and the two extension parts 291 are perpendicular to form an L-shaped structure. As shown in FIG. 11, the number of the extension parts 291 is three, two of the extension parts 291 are located on a same straight line, and the other one is perpendicular to the two extension parts 291 to form a T-shaped structure. As shown in FIG. 12, the number of the extension parts 291 is four, and the four extension parts 291 are perpendicular to form a cross-shaped structure.

Figure 17:
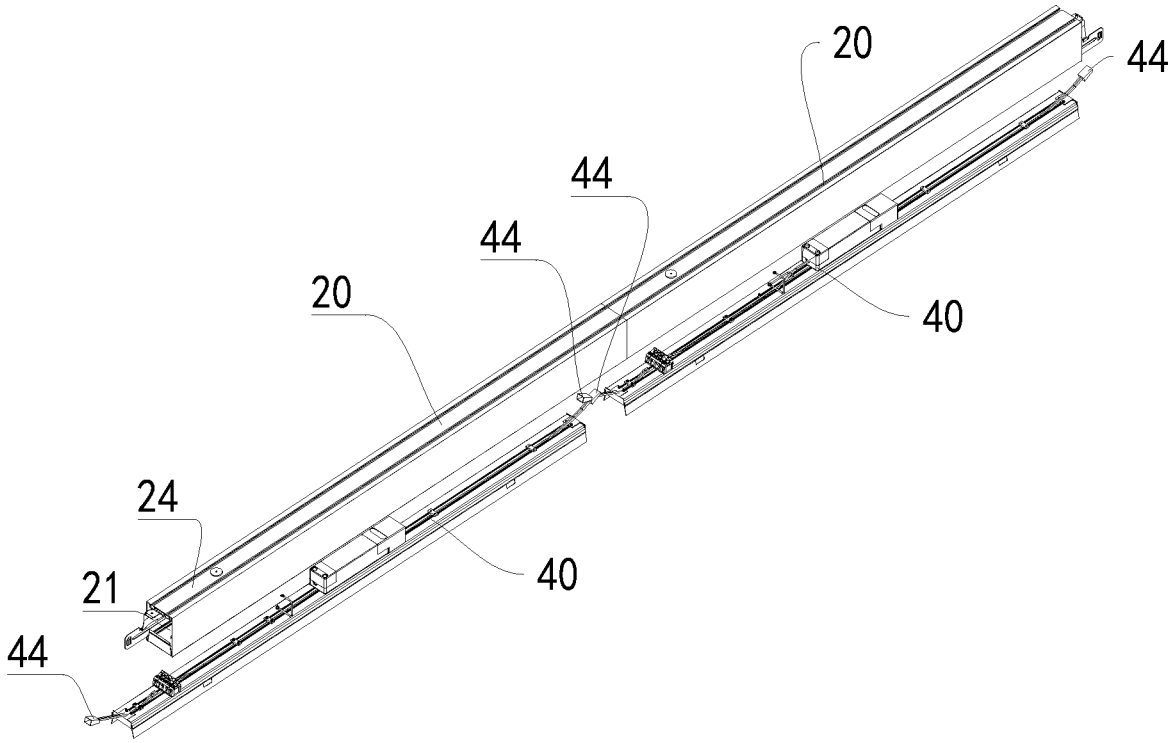
FIG. 17 is a splicing structure diagram of a photoelectric module and a housing according to an example of the present disclosure.

In the example, the linear lamp further includes a connector 30 and a photoelectric module 40, where the number of the photoelectric module 40 is at least two, the photoelectric module 40 is mounted in the housing 20 by using the connector 30, and the two adjacent photoelectric modules 40 are electrically spliced together. As shown in FIG. 17, only one photoelectric module 40 may be mounted in the first mounting space 21 of each housing 20. The photoelectric module 40 extends in the length direction of the housing 20.

Figure 18:
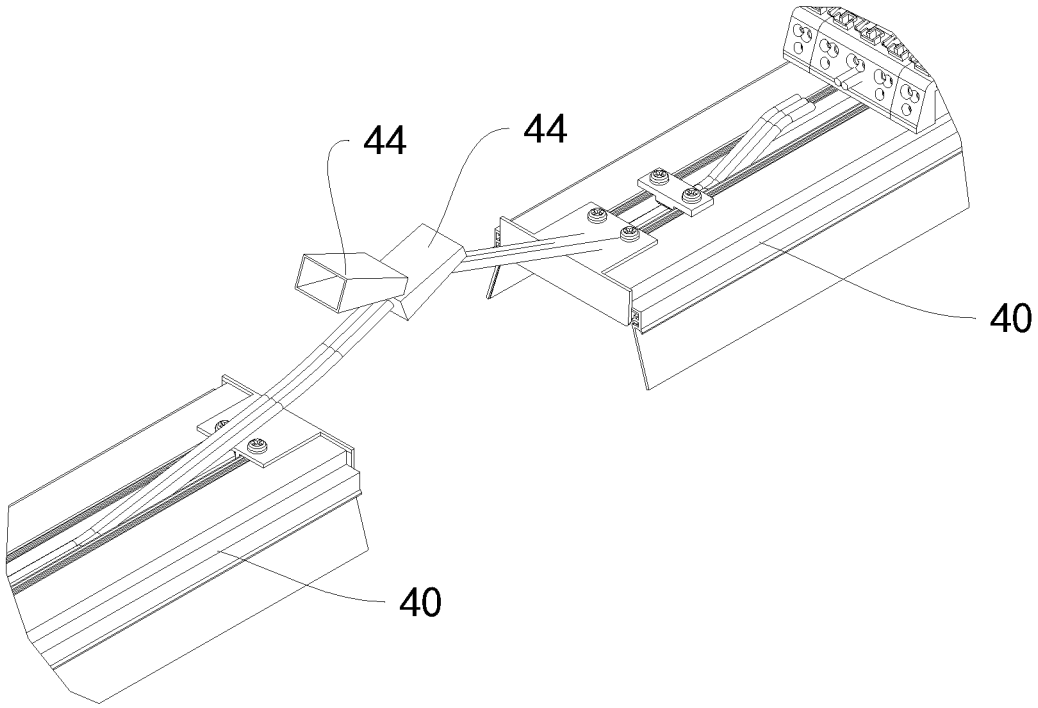
FIG. 18 is a partial view of FIG. 17.

As shown in FIG. 17 and FIG. 18, electrical connection terminals 44 are provided at two ends of the photoelectric module 40, and the electrical connection terminals 44 of the adjacent photoelectric modules 40 are electrically connected, so that the adjacent photoelectric modules 40 are connected together.

Figure 19:
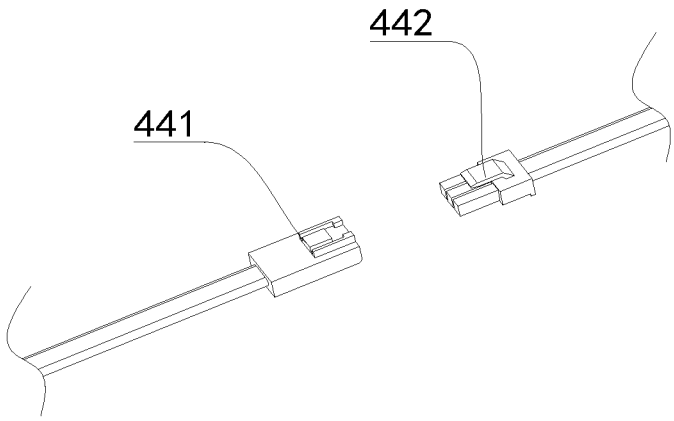
FIG. 19 is a first connection structure diagram of an electrical connection terminal according to an example of the present disclosure.
Figure 20:
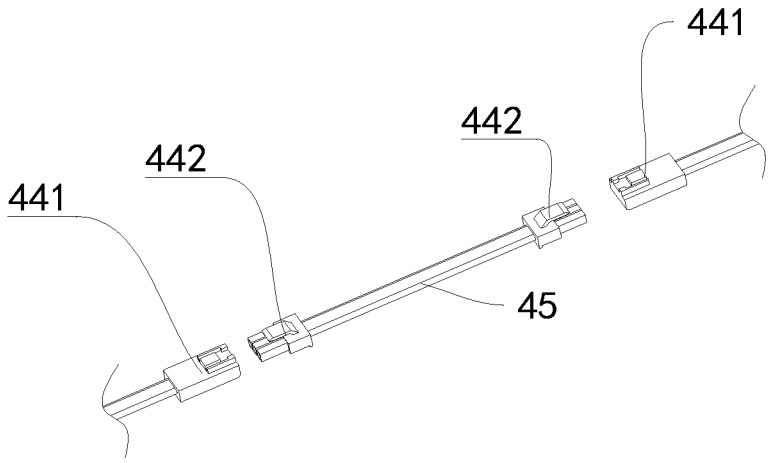
FIG. 20 is a second connection structure diagram of an electrical connection terminal according to an example of the present disclosure.
Figure 21:
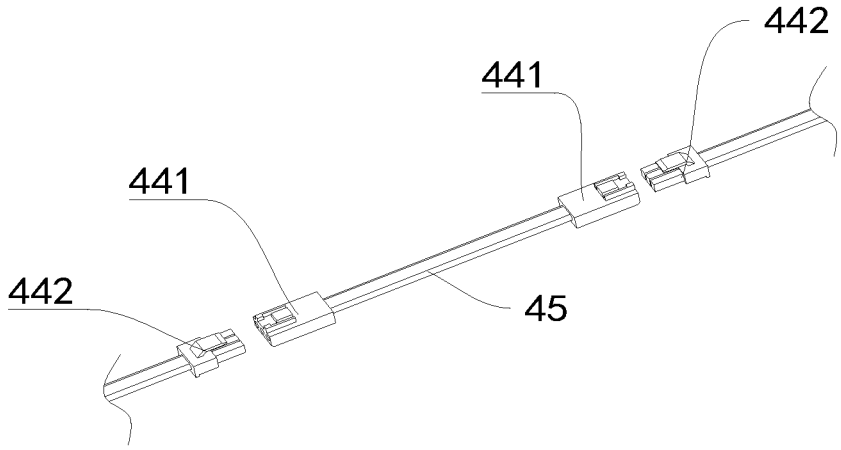
FIG. 21 is a third connection structure diagram of an electrical connection terminal according to an example of the present disclosure.

As shown in FIG. 19, the electrical connection terminals 44 at the two ends of each photoelectric module 40 may be different in structure, for example, may be a female head 441 and a male head 442 respectively. The female head 441 of one photoelectric module 40 and the male head 442 of the other photoelectric module 40 are in inserting connection cooperation. As shown in FIG. 20 and FIG. 21, when directions of the female head 441 and the male head 442 need to be changed, one conversion terminal 45 may be added. The female heads 441 may be arranged at two ends of the conversion terminal 45, or the male heads 442 may be arranged at two ends of the conversion terminal 45. The type of the conversion terminal 45 may be selected according to needs.

Figure 13:
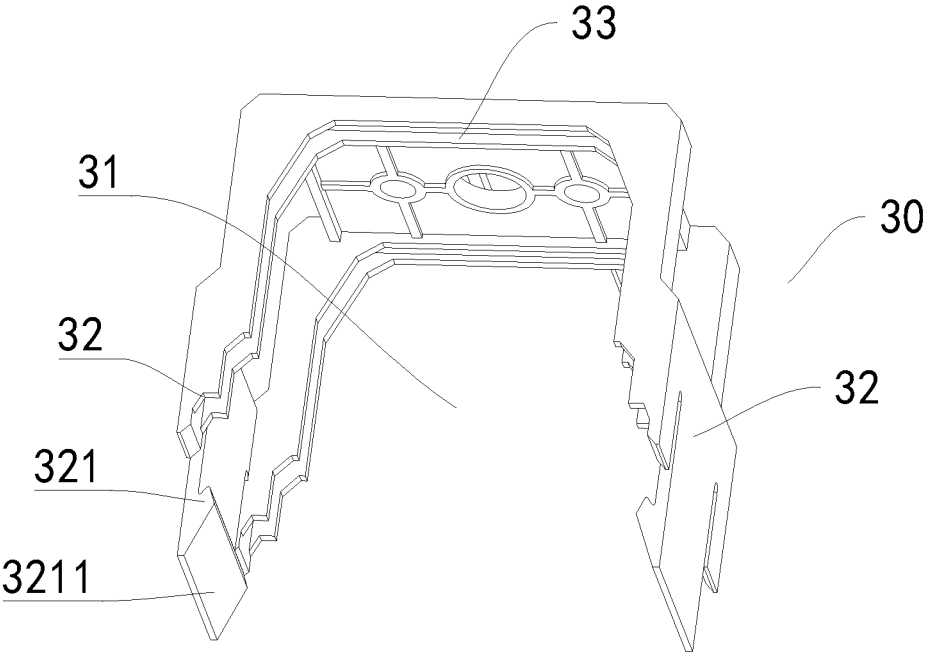
FIG. 13 is a perspective view of a connector according to an example of the present disclosure.

The housing 20 has an open end opposite to the bottom plate 24. The connector 30 is inserted into the first mounting space 21 from the open end. As shown in FIG. 13, the connector 30 has a bottom arm 33 and two side arms 32, the bottom arm 33 and the two side arms 32 are connected and enclose an accommodating cavity 31, the connector 30 has three open ends like the housing 20. The photoelectric module 40 is inserted into the accommodating cavity 31 from the open end of the connector 30 opposite to the bottom arm 33. The photoelectric module 40 may be partially or entirely located in the accommodating cavity 31. The bottom arm 33 of the connector 30 is fixed to the bottom plate 24 of the housing 20 by using a screw. The connector 30 is simple in structure and has a small occupied space. The photoelectric module 40 includes a light source plate 43, a light source 431 disposed on an outer side surface of the light source plate 43, and a power supply 46 located on an inner side of the light source plate 43, the connector 30 encloses an accommodating cavity 31, and the light source plate 43, the light source 431, and the power supply 46 are located in the accommodating cavity 31. The inner side of the light source plate 43 faces toward the bottom arm 33 and also faces toward the bottom plate 24.

The photoelectric module 40 and the connector 30 are in snap-fit connection, so that the photoelectric module 40 is convenient to be mounted. The photoelectric module 40 comprises a snap-fit body 41, a hook 321 is formed on an inner side wall of the connector 30, and the snap-fit body 41 and the hook 321 are in snap-fit connection. The hook 321 comprises a slope 3211 for the photoelectric module 40 to be conveniently inserted into the accommodating cavity 31.

Figure 14:
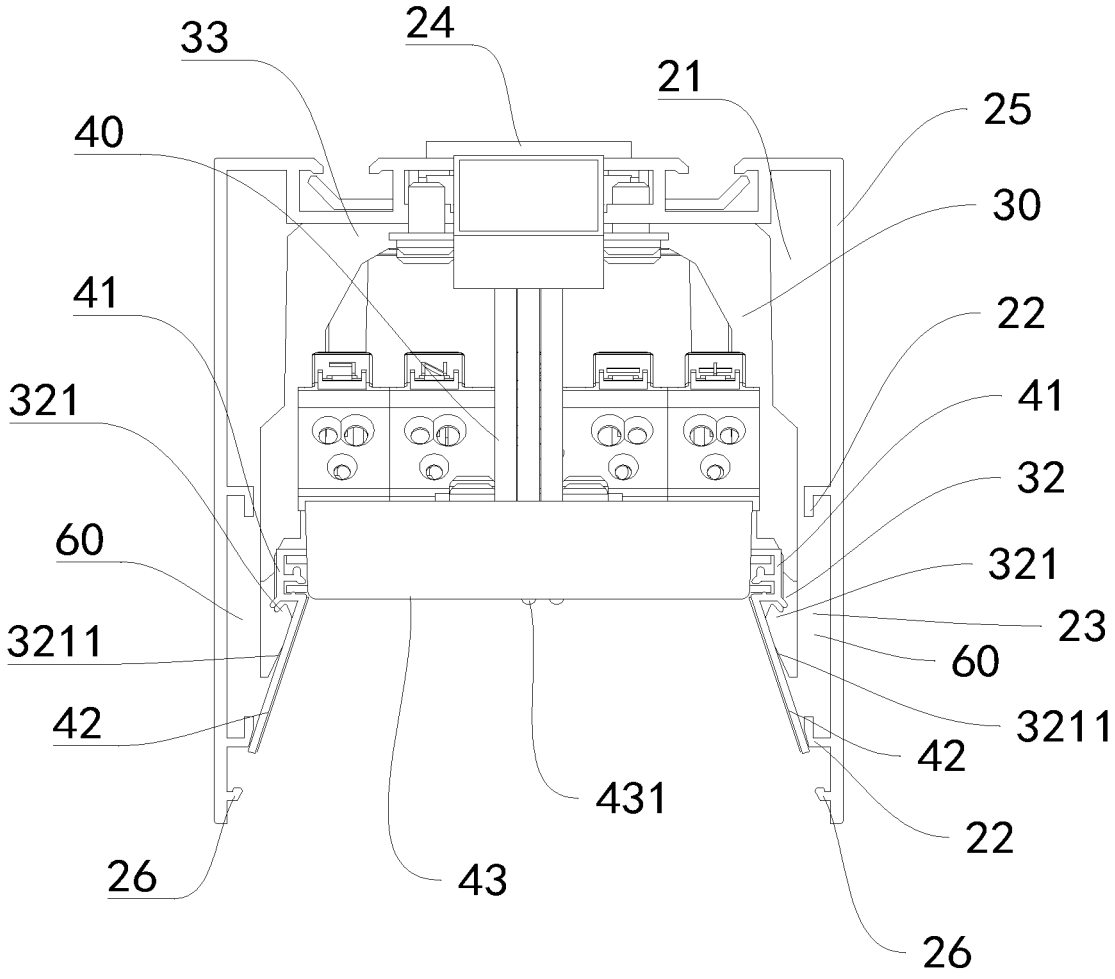
FIG. 14 is a view of connected end faces of a connector, a photoelectric module, and a housing according to an example of the present disclosure.

The side arm 32 of the connector 30 is an elastic arm in snap-fit connection with the photoelectric module 40. As shown in FIG. 14, a movement gap 60 is provided between the side arm 32 and the inner side wall of the housing 20, and the movement gap 60 is used for the side arm 32 to move. The photoelectric module 40 includes a lining plate 42 with an opening 421. At least a portion of the side arm 32 is disposed facing the opening 421, so that the side arm 32 can be pushed through the opening 421. The hook 321 is formed on an inner surface of the side arm 32.

In the example, the adjacent housings 20 are spliced together first, and then the photoelectric module 40 is mounted in the first mounting space 21 of the housing 20. In this case, the photoelectric module 40 may be moved in a length direction of the photoelectric module 40 until the opening 421 is aligned with the side arm 32, so that the side arms 32 can be pushed through the opening 421.

Figure 16:
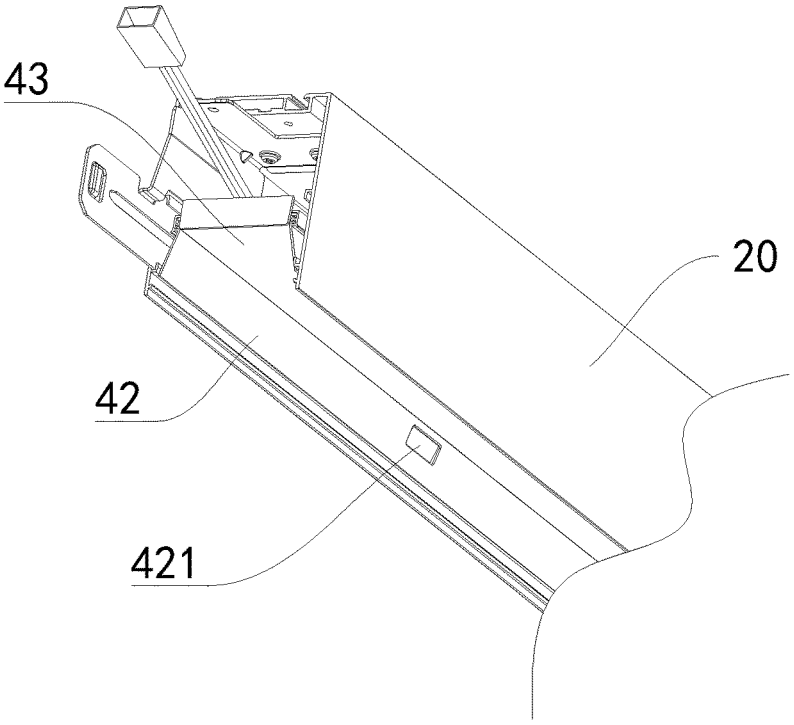
FIG. 16 is a connection structure diagram of a photoelectric module and a housing according to an example of the present disclosure.

The lining plate 42 may be a reflector. As shown in FIG. 14 to FIG. 16, the lining plates 42 are distributed on two sides of the light source plate 43 and configured to distribute light for the light source 431 on the light source plate 43, so that light emitting efficiency is improved. The reflector blocks the hook 321, the side arm 32 may be pressed through the opening 421, and the hook 321 may be separated from the snap-fit body 41, so that the photoelectric module 40 can be detached from the connector 30.

As shown in FIG. 9, the first side body 12 is longer, and the side arm 32 of the connector 30 closer to the end of the housing 20 and the inner side wall of the housing 20 are separated by the first side body 12. As shown in FIG. 8, the first side body 12 comprises an avoiding space 124 deviating from the first snap-fit part 121, and the avoiding space 124 forms a portion of the movement gap 60. The avoiding space 124 is disposed directly facing the side arm 32. The avoiding space 124 is used to ensure that the side arm 32 has a sufficient space to move, so that the side arm 32 can be separated from the snap-fit body 41 when the side arm 32 is pushed toward the inner wall of the housing 20 through the opening 421.

Provided that the second side body 13 is located between the side arm 32 of the connector 30 and the inner side wall of the housing 20, an avoiding space also needs to be provided on the second side body 13, so that the photoelectric module 40 can be conveniently detached.

Figure 22:
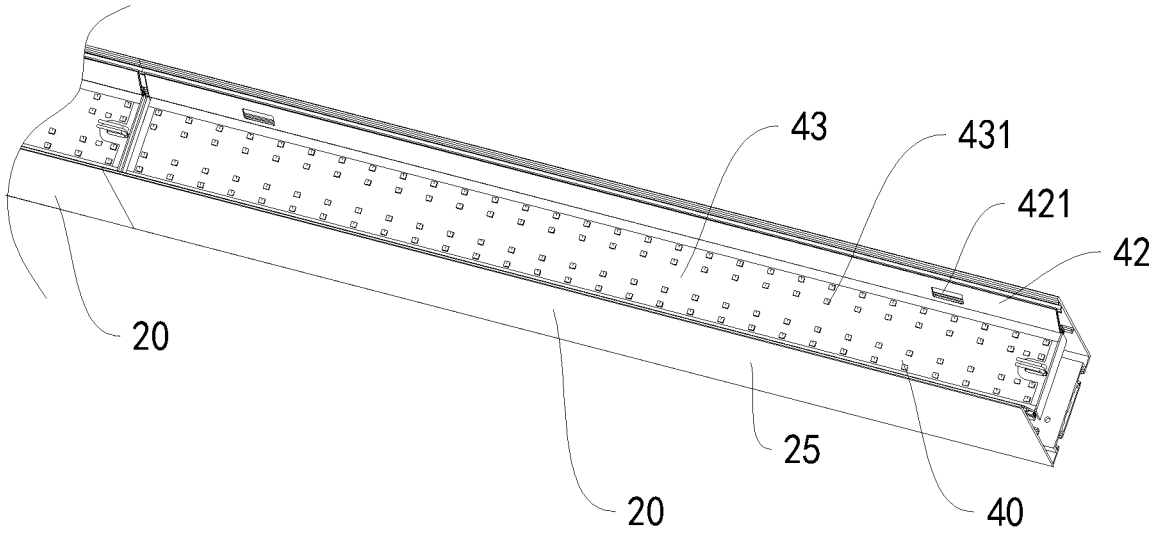
FIG. 22 is a diagram illustrating distribution of light sources according to an example of the present disclosure.

As shown in FIG. 22, several groups of light sources 431 arranged at intervals in a length direction are provided on the light source plate 43, and after the two adjacent photoelectric modules 40 are spliced, distances between two adjacent groups of light sources 431 in any position are the same, so that light emitting uniformity can be ensured. Specifically, distances between the two adjacent groups of light sources 431 in a spliced position need to be the same as distances between the two adjacent groups of light sources 431 in another position. The distances are still deemed as the same within a tolerance range of a machining error.

Figure 23:
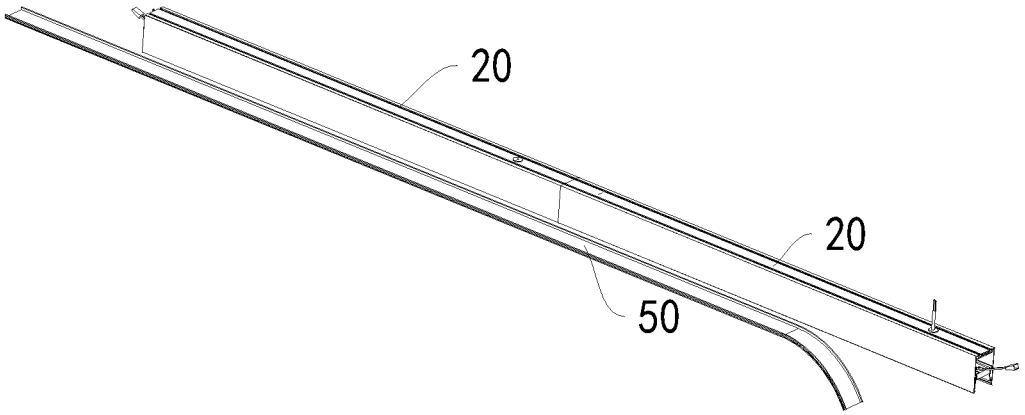
FIG. 23 is an exploded view of a housing and a light distribution component according to an example of the present disclosure.

As shown in FIG. 23, the linear lamp further includes a light distribution component 50, where the light distribution component 50 is an integrally formed member, and the adjacent housings 20 are both connected to the light distribution component 50. The light distribution component 50 may be a diffusion cover. As shown in FIG. 14 and FIG. 23, a snap-fit strip 26 is provided on the inner wall of the housing 20, the snap-fit strip 26 extends in the length direction of the housing 20, and a distance between the snap-fit strip 26 and the bottom plate 24 of the housing 20 is greater than a distance between any strip-shaped rib 22 and the bottom plate 24. The snap-fit strip 26 and the light distribution component 50 are in snap-fit connection, so that the connection is facilitated. The entire diffusion cover facilitates improving light emitting uniformity.

As shown in FIG. 10 to FIG. 12, a mounting cavity is provided in the extension part 291, the photoelectric module 40 is mounted in the mounting cavity, and the splicing member 10 is mounted at an outer end of the extension part 291. The transition module 29 is spliced with the straight-line shape housing 20 by using the splicing member 10, and the photoelectric module 40 in the transition module 29 is spliced with the photoelectric module 40 in the straight-line shape housing 20.

Figure 25:
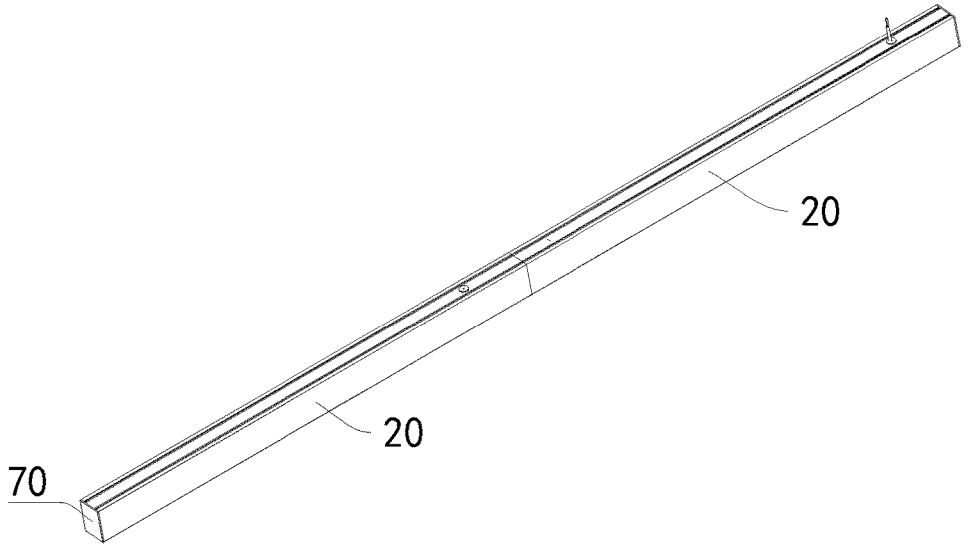
FIG. 25 is an entire diagram of a linear lamp according to an example of the present disclosure.

As shown in FIG. 24 and FIG. 25, end covers 70 are mounted at two ends of the housing 20, and the end covers 70 may be connected to the housing 20 by using screws. As shown in FIG. 24 and FIG. 25, the number of the housings 20 is two, or the number of the housings 20 may be two or more. For example, a lamp shell of the linear lamp is formed by splicing six housings 20. The six housings 20 may be distributed on one straight line, or may be distributed on different straight lines by using the transition module 29.

In the example, the adjacent housings 20 of the linear lamp are convenient to be spliced, the adjacent photoelectric modules 40 are convenient to be spliced, the light distribution component 50 is convenient to be mounted, and the linear lamp is uniform in light emitting.

The present disclosure provides a linear lamp.

The linear lamp may include housings and a splicing member, the number of the housings may be at least two, the splicing member may be mounted at an end of each of the housings, and the two adjacent splicing members may be in snap-fit connection to splice the two adjacent housings together.

In one example of the linear lamp, facing end faces of the two adjacent housings are attached to each other.

In one example of the linear lamp, the splicing member comprises a main body, a first side body, and a second side body, the first side body and the second side body are connected to and distributed on opposite sides of the main body, the first side body comprises a first snap-fit part, the second side body comprises a second snap-fit part, and the first snap-fit part of one splicing member and the second snap-fit part of the adjacent splicing member are in snap-fit connection.

In one example of the linear lamp, the first side body of one splicing member is limited in an outward direction by one of inner side walls of the housing, the first side body of the adjacent splicing member is limited in an outward direction by another of the inner side walls of the housing, and the second side body is located on an inner side of the first side body and exerts outward extrusion force on the first side body.

In one example of the linear lamp, a slot is provided on the inner side wall, and the first side body is inserted in the slot.

In one example of the linear lamp, the splicing member further comprises a first connection body and a second connection body, the first connection body is connected to the main body and the first side body, the second connection body is connected to the main body and the second side body, and the first connection body is bent toward the inner side wall adjacent to the first connection body, and the second connection body is bent toward the inner side wall adjacent to the second connection body.

In one example of the linear lamp, the first snap-fit part protrudes out of an inner side surface of the first side body.

In one example of the linear lamp, the first side body comprises a through-hole (122) which is disposed adjacent to the first snap-fit part, and at least a portion of the second snap-fit part is located in the through-hole.

In one example of the linear lamp, the second snap-fit part protrudes out of an outer side surface of the second side body.

In one example of the linear lamp, the second snap-fit part extends from one end face of the second side body to another end of the second side body, and a groove is provided on the one end face of the second side body.

In one example of the linear lamp, a second guide part bent toward the first side body is provided on the another end.

In one example of the linear lamp, the first side body and the second side body both extend in a length direction of the housing, a length of the first side body is greater than a length of the second side body, the first snap-fit part of one of the housing extends into an inner cavity of the adjacent housing.

In one example of the linear lamp, the linear lamp further comprises a connector and at least two photoelectric modules, wherein the at least two photoelectric modules are mounted in the housing by using the connector, and the two adjacent photoelectric modules are electrically spliced together.

In one example of the linear lamp, each of the photoelectric modules comprises a light source plate, a light source disposed on an outer side surface of the light source plate, and a power supply located on an inner side of the light source plate, the connector encloses an accommodating cavity, and the light source plate, the light source, and the power supply are located in the accommodating cavity.

In one example of the linear lamp, the photoelectric module and the connectors are in snap-fit connection.

In one example of the linear lamp, the photoelectric module includes a snap-fit body, the connector comprises a hook, and the snap-fit body and the hook are in snap-fit connection.

In one example of the linear lamp, the connector comprises a side arm, the side arm is an elastic arm being in snap-fit connection with the photoelectric module, a movement gap for the side arm (32) to move is provided between the side arm and the housing, and the photoelectric module comprises an opening corresponding to the side arm.

In one example of the linear lamp, the first side body or the second side body comprises an avoiding space, and the movement gap comprises the avoiding space.

In one example of the linear lamp, the photoelectric module includes a plurality of groups of the light sources arranged at intervals in a length direction of the photoelectric module, and after the two adjacent photoelectric modules are spliced, distances between two adjacent groups of the light sources in any position are a same.

In one example of the linear lamp, the linear lamp further comprises a light distribution component, the light distribution component is an integrally formed member, and the adjacent housings are both connected to the light distribution component.

Compared with the existing linear lamp that connects adjacent housings by a screw, the linear lamp of the present disclosure has the advantage that: the two adjacent splicing members are in snap-fit connection and then the two adjacent housings are spliced together, and the two adjacent housings can be spliced quickly and conveniently.

The present disclosure may include dedicated hardware implementations such as application specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

What are described above is related to the examples of the present disclosure only and not limitative to the scope of the present disclosure. For those skilled in the art, the present disclosure may have various changes and modifications. Any modification, equivalent replacement, improvement and the like made within the spirit and principle of the present disclosure shall be included within the scope of the present disclosure.

The invention claimed is:

1. A linear lamp, comprising housings and splicing members, wherein:

a number of the housings is at least two, a splicing member is mounted at an end of each of the housings, a splicing member at an end of a housing of the number of the housings is connected to a splicing member at an end of an adjacent housing of the number of the housings, the two splicing members are adjacent, the two adjacent splicing members are in snap-fit connection to splice the two adjacent housings together, the splicing member comprises a main body, a first side body, and a second side body, the first side body and the second side body are connected to and distributed on opposite sides of the main body, and the first side body comprises a first snap-fit part.

2. The linear lamp according to claim 1, wherein facing end faces of the two adjacent housings are attached to each other.

3. The linear lamp according to claim 1, wherein the second side body comprises a second snap-fit part, and the first snap-fit part of one splicing member and the second snap-fit part of the splicing member adjacent to the one splicing member are in snap-fit connection.

4. The linear lamp according to claim 3, wherein the first side body of one splicing member is limited in an outward direction by one of inner side walls of the housing, the first side body of the splicing member adjacent to the one splicing member is limited in an outward direction by another of the inner side walls of the housing, and the second side body is located on an inner side of the first side body and exerts outward extrusion force on the first side body.

5. The linear lamp according to claim 4, wherein the inner side wall comprises a slot, and the first side body is inserted in the slot.

6. The linear lamp according to claim 5, wherein the splicing member further comprises a first connection body and a second connection body, the first connection body is connected to the main body and the first side body, the second connection body is connected to the main body and the second side body, and the first connection body is bent toward the inner side wall adjacent to the first connection body, and the second connection body is bent toward the inner side wall adjacent to the second connection body.

7. The linear lamp according to claim 3, wherein the first snap-fit part protrudes out of an inner side surface of the first side body.

8. The linear lamp according to claim 7, wherein the first side body comprises a through-hole which is disposed adjacent to the first snap-fit part, and at least a portion of the second snap-fit part is located in the through-hole.

9. The linear lamp according to claim 7, wherein the second snap-fit part protrudes out of an outer side surface of the second side body.

10. The linear lamp according to claim 9, wherein the second snap-fit part extends from one end face of the second side body to another end of the second side body, and a groove is provided on the one end face of the second side body.

11. The linear lamp according to claim 10, wherein a second guide part bent toward the first side body is provided on the another end.

12. The linear lamp according to claim 3, wherein the first side body and the second side body both extend in a length direction of the housing, a length of the first side body is greater than a length of the second side body, the first snap-fit part of one housing extends into an inner cavity of the housing adjacent to the one housing.

13. The linear lamp according to claim 1, wherein the linear lamp further comprises a connector and photoelectric modules, the photoelectric modules are mounted in the housing by using the connector, and the two adjacent photoelectric modules are electrically spliced together.

14. The linear lamp according to claim 13, wherein:

each of the photoelectric modules comprises a light source plate, a light source disposed on an outer side surface of the light source plate, and a power supply located on an inner side of the light source plate, and the connector encloses an accommodating cavity, and the light source plate, the light source, and the power supply are located in the accommodating cavity.

15. The linear lamp according to claim 13, wherein the photoelectric module and the connectors are in snap-fit connection.

16. The linear lamp according to claim 15, wherein the photoelectric module includes a snap-fit body, the connector comprises a hook, and the snap-fit body and the hook are in snap-fit connection.

17. The linear lamp according to claim 14, wherein the connector comprises a side arm, the side arm is an elastic arm being in snap-fit connection with the photoelectric module, a movement gap for the side arm to move is provided between the side arm and the housing, and the photoelectric module comprises an opening corresponding to the side arm.

18. The linear lamp according to claim 17, wherein the first side body or the second side body comprises an avoiding space, and the movement gap comprises the avoiding space.

19. The linear lamp according to claim 13, wherein the photoelectric module comprises a plurality of groups of the light sources arranged at intervals in a length direction of the photoelectric module, and after the two adjacent photoelectric modules are spliced, distances between two adjacent groups of the light sources in any position are a same.

20. The linear lamp according to claim 1, wherein the linear lamp further comprises a light distribution component, the light distribution component is an integrally formed member, and the adjacent housings are both connected to the light distribution component.

* * * * *